US007005783B2

(12) United States Patent
Hwu et al.

(10) Patent No.: US 7,005,783 B2
(45) Date of Patent: Feb. 28, 2006

(54) SOLID STATE VACUUM DEVICES AND METHOD FOR MAKING THE SAME

(75) Inventors: RueyJen Hwu, Salt Lake City, UT (US); Larry Sadwick, Salt Lake City, UT (US)

(73) Assignee: Innosys, Inc., Salt Lake City, UT (US)

( * ) Notice: Subject to any disclaimer, the term of this patent is extended or adjusted under 35 U.S.C. 154(b) by 112 days.

(21) Appl. No.: 10/067,625

(22) Filed: Feb. 4, 2002

(65) Prior Publication Data

US 2003/0146681 A1 Aug. 7, 2003

(51) Int. Cl.
*H01J 1/46* (2006.01)
*H01J 21/10* (2006.01)

(52) U.S. Cl. ..... 313/293

(58) Field of Classification Search ..... 313/582, 313/583, 584, 585, 586, 587, 495, 496, 497, 313/498, 504, 506, 293; 257/13, 83, 86
See application file for complete search history.

(56) References Cited

U.S. PATENT DOCUMENTS

| | | | | |
|---|---|---|---|---|
| 3,701,919 | A | | 10/1972 | Geppert |
| 3,789,471 | A | | 2/1974 | Spindt et al. |
| 3,855,499 | A | | 12/1974 | Yamada et al. |
| 3,921,022 | A | | 11/1975 | Levine |
| 3,970,887 | A | | 7/1976 | Smith et al. |
| 3,978,364 | A | | 8/1976 | Dimeff et al. |
| 4,019,081 | A | | 4/1977 | Buxbaum et al. |
| 4,138,622 | A | | 2/1979 | McCormick et al. |
| 4,712,039 | A | | 12/1987 | Hong |
| 4,721,885 | A | | 1/1988 | Brodie |
| 4,855,636 | A | | 8/1989 | Busta et al. |
| 4,924,137 | A | | 5/1990 | Watanabe et al. |
| 4,983,878 | A | | 1/1991 | Lee et al. |
| 4,987,377 | A | | 1/1991 | Gray et al. |
| 5,038,070 | A | | 8/1991 | Bardai et al. |
| 5,053,673 | A | | 10/1991 | Tomii et al. |
| 5,181,874 | A | | 1/1993 | Sokolich et al. |
| 5,199,918 | A | | 4/1993 | Kumar |
| 5,411,426 | A | | 5/1995 | Boysel |
| 5,463,277 | A | | 10/1995 | Kimura et al. |
| 5,475,281 | A | * | 12/1995 | Heijboer ..... 313/337 |
| 5,502,314 | A | | 3/1996 | Hori |
| 5,598,052 | A | * | 1/1997 | Khan et al. ..... 313/310 |
| 5,686,790 | A | * | 11/1997 | Curtin et al. ..... 313/493 |
| 5,841,219 | A | | 11/1998 | Sadwick et al. |
| 5,955,828 | A | | 9/1999 | Sadwick et al. |
| 6,291,288 | B1 | | 9/2001 | Huang et al. |
| 6,465,132 | B1 | * | 10/2002 | Jin ..... 429/231.8 |

* cited by examiner

*Primary Examiner*—Joseph Williams
*Assistant Examiner*—Peter Macchiarolo
(74) *Attorney, Agent, or Firm*—Morriss O'Bryant Compagni, P.C.

(57) ABSTRACT

A solid state vacuum device (SSVD) and method for making the same. In one embodiment, the SSVD forms a triode device comprising a substrate having a cavity formed therein. The SSVD further comprises an anode positioned in the cavity of the substrate, a cathode suspended over the cavity of the substrate, and a grid positioned between the cathode and anode. In addition, the SSVD comprises a seal for creating a vacuum environment in the area surrounding the grid, cathode, and anode. Upon applying heat to the cathode, electrons are released from the cathode, passed through the grid, and received by the anode. In response to receiving the electrons, the anode produces a current. The current produced by the anode is controlled by a voltage applied to the grid. Other embodiments of the present invention provide diode, tetrode, pentode, and other higher order device configurations.

4 Claims, 9 Drawing Sheets

SOLID STATE VACUUM DEVICES AND METHOD FOR MAKING THE SAME

FIELD OF THE INVENTION

The present invention relates to semiconductor devices and vacuum devices, and in particular, to devices configured to operate in a vacuum environment and devices manufactured through microelectronic, micro electro-mechanical systems (MEMS), micro system technology (MST), micromachining, and semiconductor manufacturing processes.

BACKGROUND OF THE INVENTION

Vacuum tubes were developed at or around the turn of the century and immediately became widely used for electrical amplification, rectification, oscillation, modulation, and wave shaping in radio, television, radar, and in all types of electrical circuits. With the advent of the transistor in the 1940s and 1950s and integrated circuit technology in the 1960s, the use of the vacuum tube began to decline, as circuits previously employing vacuum tubes were adapted to utilize solid state transistors. The result is that today more circuits are utilizing solid state semiconductor devices, with vacuum tubes remaining in use only in limited circumstances such as those involving high power, high frequency, or severe environmental applications. In these limited circumstances, solid state semiconductor devices generally cannot accommodate the high power, high frequency or severe environmental conditions.

There have been a number of attempts at fabricating vacuum tube devices using solid state semiconductor device fabrication techniques. One such attempt resulted in a thermionic integrated circuit formed on the top side of a substrate, with cathode elements and corresponding grid elements being formed co-planarly on the substrate. The anodes for the respective cathode/grid pairs were fabricated on a separate substrate, which was aligned with the first-mentioned substrate such that the cathode to anode spacing was on the order of one millimeter. With this structure, all the cathode elements were collectively heated via a filament heater deposited on the backside of the substrate. Accordingly, this structure required a relatively high temperature to operate and required substrate materials with a high electrical resistivity at elevated temperatures. In addition, the structure described above presented other problems, including: inter-electrode electron leakage, electron leakage between adjacent devices, and a limited cathode life.

SUMMARY OF THE INVENTION

The present invention provides a solid state vacuum device (SSVD) that operates in a manner similar to that of a traditional vacuum tube amplifier. In one embodiment, the SSVD comprises a cathode, anode, and a grid. In alternative embodiments, the SSVD also comprises a plurality of grid layers, also referred to as a plurality of electrodes. In one embodiment, the cathode is heated by a structure via a circuit that causes the cathode to emit electrons. As described in further detail below, this configuration is referred to as an indirectly heated cathode. In another embodiment, which is referred to as a directly heated cathode, a heater circuit provides energy/power to a structure that is directly part of, and in electrical contact with, the cathode, which emits electrons when heated. The electrons are passed through the grid(s) and are received by the anode. In response to receiving the electrons from the cathode, the anode produces a current that is fed into an external circuit. The magnitude of the flow of electrons through the grid is regulated by a control circuit that supplies a voltage or voltage waveform to the grid. Accordingly, the predetermined voltage applied to the grid controls the electrical current produced at the anode.

In one embodiment, the present invention provides SSVD in a triode configuration. In this embodiment, the SSVD comprises a substrate having a cavity formed in the substrate. The SSVD further comprises an anode positioned in the cavity of the substrate, a cathode suspended over the cavity of the substrate, and a grid positioned between the cathode and anode. The grid comprises at least one aperture for directing the passage of electrons from the cathode to the anode, and the grid is constructed of an electronically-conductive material. In addition, the SSVD comprises an enclosed housing for creating a vacuum environment in an area surrounding the grid, cathode, and anode.

In another embodiment, the present invention provides an SSVD in a diode configuration. In this embodiment, the SSVD comprises a substrate having a cavity formed in the substrate. The SSVD further comprises an anode positioned in the cavity of the substrate and a cathode suspended over the cavity. The SSVD also comprises an enclosed housing for creating a vacuum environment in an area between the cathode and anode.

In other embodiments, the present invention provides solid state vacuum devices in tetrode and pentode configurations. In these embodiments, the SSVD comprises a substrate having a cavity formed in the substrate. The SSVD further comprises an anode positioned in the cavity of the substrate, a cathode suspended over the cavity of the substrate, and a plurality of grid layers positioned between the cathode and anode. More specifically, these embodiments of the SSVD comprise two grid layers in the tetrode configuration and three grid layers in the pentode configuration. In yet another embodiment, the SSVD comprises two aligned grid layers in a tetrode configuration, where the aligned grid layers provide an increased power generation capacity that is characteristic of a pentode. The grid layers comprise at least one aperture for directing the passage of electrons from the cathode to the anode. By the use of the novel fabrication methods of the present invention, other higher order devices may be constructed by providing additional grid layers to the SSVD structures described herein.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

The present invention provides a micron-scale, solid state vacuum device that operates in a manner similar to that of a traditional vacuum tube amplifier. As described below, the present invention provides a plurality of embodiments where a solid state vacuum device is configured to form a diode, triode, tetrode, and other higher order devices made from novel semiconductor fabrication techniques. The following sections provide a detailed description of each embodiment and several methods for making the devices disclosed herein. Supplemental information is also provided in a contemporaneously filed patent application entitled "Solid State Vacuum Devices and Method for Making the Same," which is commonly assigned to InnoSys, Inc. of Salt Lake City, Utah, and naming Ruey-Jen Hwu and Larry Sadwick as co-inventors; the subject matter of which is incorporated by reference.

Figure 1:
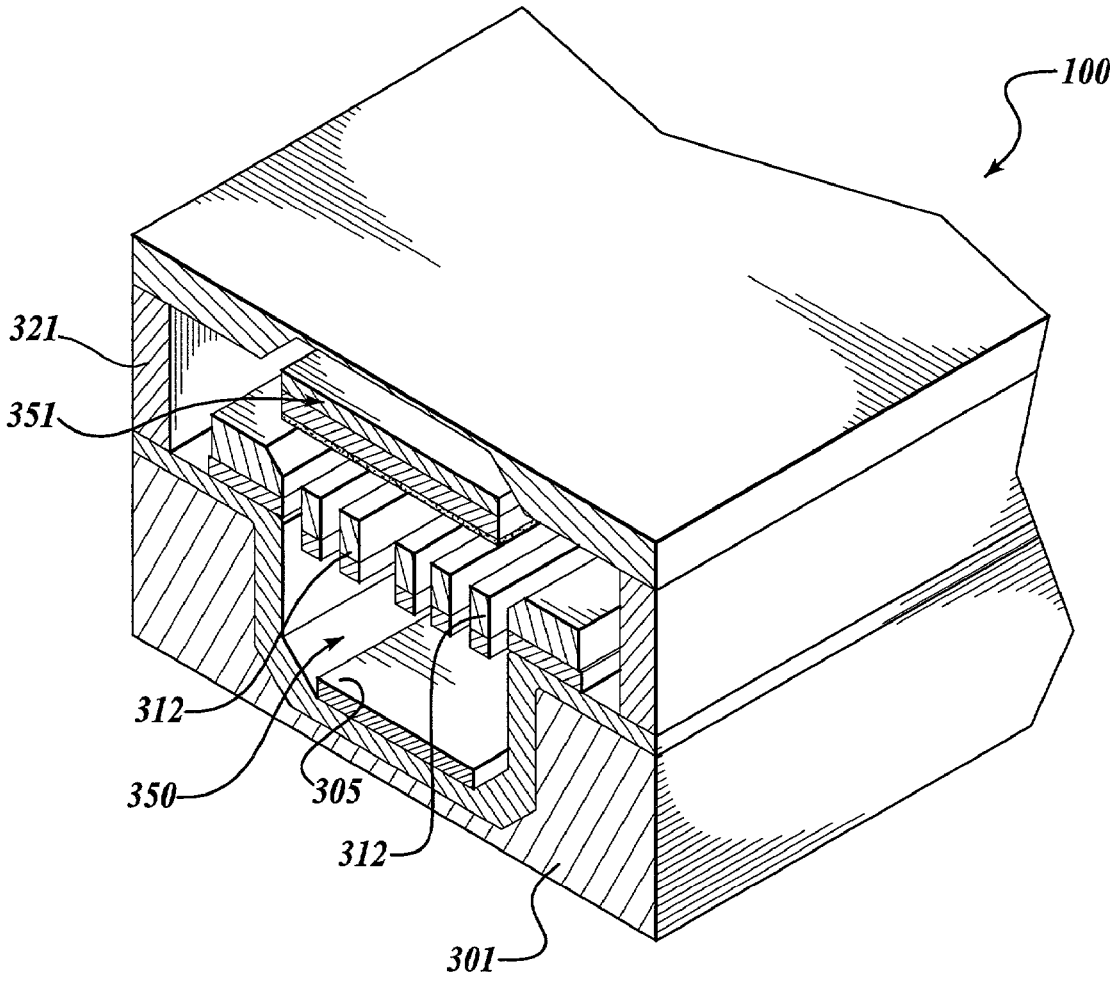
FIG. 1 is a top front cross-sectional perspective view of one embodiment of a solid state vacuum device in accordance with the present invention.

Referring now to FIG. 1, the basic elements of one embodiment of a triode solid state vacuum device 100 (hereinafter referred to as the triode 100) are shown. Generally described, the triode 100 comprises a substrate 301 having a cavity 350 formed in the substrate 301. The cavity 350 of this embodiment is a void with an upper opening and a continuous wall formed by the substrate 301 to define the boundings of the void. The triode 100 further comprises an anode 305 positioned in the cavity of the substrate 301, a cathode 351 suspended over the cavity of the substrate 301, and a grid 312 positioned between the cathode 351 and anode 305. In addition, the triode 100 comprises a sealed enclosure for creating a controlled environment in the area surrounding the grid 312, cathode 351, and anode 305. The controlled environment allows charged carriers, such as electrons, to move between the cathode 351, grid 312, and anode 305.

In the operation of the triode 100, the cathode 351, in one embodiment, is heated by a circuit that causes the cathode 351 to emit charged carriers, such as electrons. Other possible electron emission mechanisms include photo-induced emission, electron injection, negative affinity, etc. Such alternate embodiments can be used separately or in conjunction with the thermionic emission. In one set of embodiments, the cathode is heated by a circuit that causes the cathode to emit electrons; this configuration is referred to as an indirectly heated cathode. In another configuration which is referred to as a directly heated cathode, the heater circuit provides energy/power to a structure that is directly part of and in electrical contact with the cathode and it emits electrons when it is heated. The emitted electrons pass through the grid 312 and are received by the anode 305. In response to receiving the electrons from the cathode 351, the anode 305 produces a current. The magnitude of the flow of electrons through the grid 312 is controlled by a circuit that supplies a voltage or voltage waveform to the grid 312. Accordingly, the voltage applied to the grid 312 controls the electrical current produced by the anode 305.

Figure 2A:
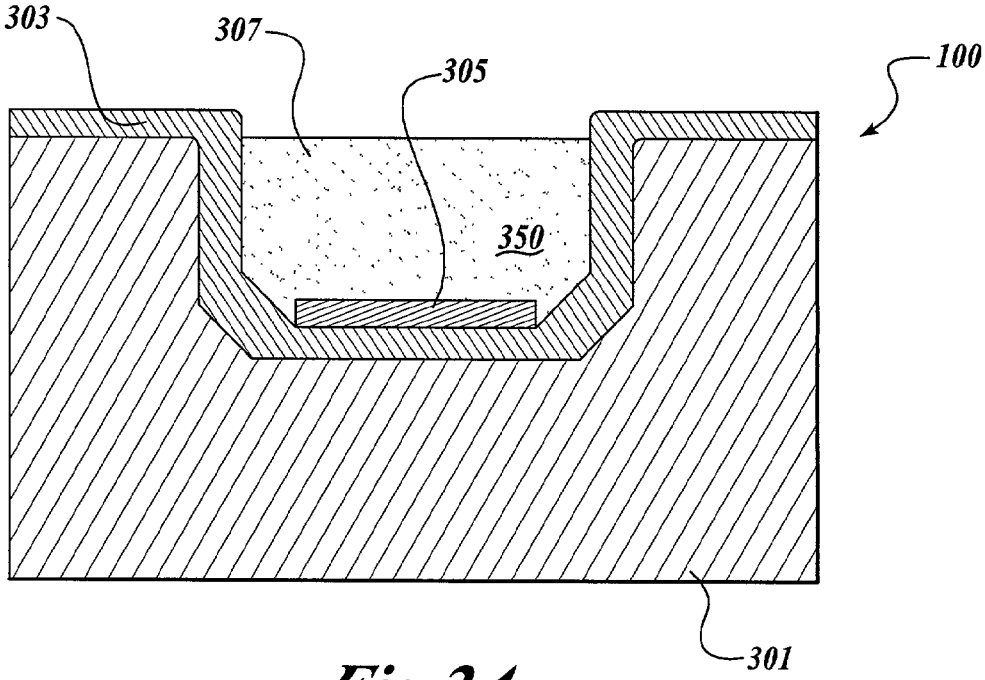
FIGS. 2A–2E illustrate several steps employed in one embodiment of a fabrication process for forming a triode having an anode positioned in a substrate cavity.

Referring now to FIGS. 2A–2E, one embodiment of a fabrication process forming a triode 100 (FIG. 1) is shown and described. FIG. 2A is a side, cross-sectional view of the various components utilized in the fabrication process. As described below, the triode 100 and all other solid state vacuum devices described are constructed by the use of solid state semiconductor fabrication techniques, such as thin film disposition, sputtering, etc. Accordingly, sub-micron, micron, and larger than micron scale dimensions may be achieved in the construction of each embodiment. In one aspect of the present invention, the smaller scale dimensions and various forms of each embodiment provide various improvements over conventional vacuum tube devices. For instance, the embodiments of the present invention enhance device transconductance (current per applied voltage), bandwidth and frequency performance of the devices. These benefits are made possible because the smaller dimensions allow the implementation of optimal grid design, i.e., smaller necessary grid spacing and grid to cathode distance that were not possible in conventional vacuum tube devices.

In one embodiment, the triode 100 may be constructed on a substrate 301, which may be made of a single crystal, polycrystalline material, amorphous material, any other semiconductor or any other appropriate substrate depending on application. For instance, the substrate 301 may be made of polycrystalline silicon, amorphous silicon, silicon, gallium arsenide semiconductor substrates, glass, ceramic, metals, metal oxides, etc., or the like.

Figure 3A:
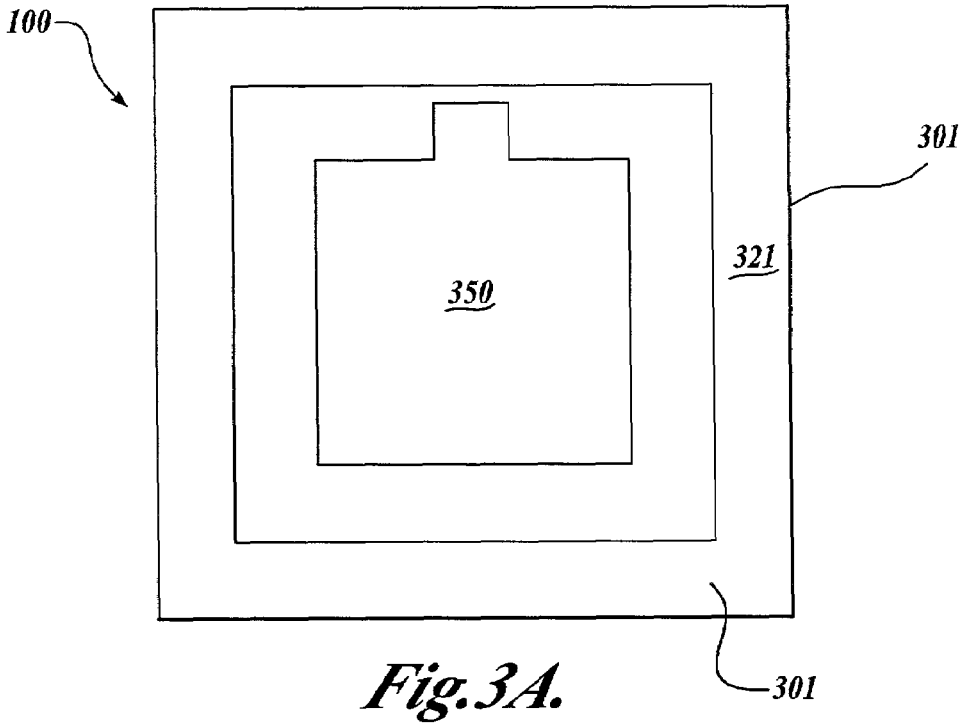
FIG. 3A is a top view of a substrate utilized in the construction of the embodiment of the solid state vacuum device depicted in FIG. 2E.

As shown in FIG. 2A, a cavity 350 is formed in the top surface of the substrate 301. In one embodiment, the cavity 350 is etched to a depth between 150–200 microns. Although this illustrative embodiment utilizes these dimensions of the cavity 350, the scope of the present invention also includes any cavity in the substrate 301 having a depth greater than or less than the dimensions disclosed herein. In other embodiments, referred to as the through-hole embodiment, the triode 100 may include a cavity 350 that extends all the way through the substrate 301. In this embodiment, the substrates of choice are usually an insulating type such as ceramic, glasses, etc. In one embodiment, the cavity 350 may be in a square configuration as shown in FIG. 3A. In the implementation of the solid state vacuum devices described herein, the cavity 350 may be in any shape or form other than a square or rectangle configuration. For instance, the cavity 350 may be in the form of a triangle, trapezoid, circle, oval, etc. In other embodiments, the cavity 350 may be a cylindrical shaped cavity formed in the top surface of the substrate 301. In addition, no specific aspect ratio is required in the configuration of the cavity 350. The cavity 350 may be etched into the substrate 301 by a number of known fabrication processes, such as a wet etch, dry etch, or any other like method. As known to one of ordinary skill in the art, a patterned mask layer and an effective etchant, e.g., sulfuric acid ($H_2SO_4$), or potassium hydroxide (KOH) may be used to create the cavity 350. Methods employed to make the through-hole embodiment, which involves an insulating substrate such as ceramic, glass, etc., include etching, punching, preformed materials, drilling, milling, microdrilling, micromilling, laser techniques including laser ablation and other laser removal and/or deposition techniques.

As shown in FIG. 2A, the triode 100 further comprises an oxidation layer 303 deposited on the top surface of the substrate 301. Also shown, the oxidation layer 303 is also applied such that it covers the surface of the cavity 350. The oxidation layer 303 may be made of any insulating material such as silicon dioxide ($SiO_2$) or the like. The oxidation layer 303 may be applied to the substrate 301 by the use of any generally known fabrication method such as wet oxidation, sputtering evaporation, or any other like method. In one embodiment, the oxidation layer 303 may be applied on the substrate 301 at a thickness of approximately two microns. Although this illustrative embodiment comprises an oxidation layer having a thickness of two microns, any thickness and/or dimension of the oxidation layer may be used in the construction of the triode 100.

Also shown in FIG. 2A, the triode 100 further comprises an anode 305 that is disposed on the oxidation layer 303 and positioned in the cavity 350. In one embodiment, the anode 305 is configured to have a thickness between one micron and one millimeter. Although these dimensions for the anode 305 thickness are presented for this illustrative example, any thickness and/or dimension may be used in the construction of the anode 305. The anode 305 may be constructed of any conductive material such as tantalum, gold, tungsten, molybdenum, copper, or the like.

The anode 305 may be positioned in any orientation relative to the oxidation layer 303 and the substrate 301. For instance, in one embodiment, the anode 305 may be configured to extend from the bottom surface of the cavity 350 to the bottom surface of the substrate 301. In this embodiment, the substrate 301 may be made from any material, but preferably made from a glass-based material.

Any known fabrication process of disposing a conductive layer may be used to form the anode 305. In one embodiment, the formation of the anode 305 can be achieved by many ways including electroplating evaporation, metal sputtering, etc. In the through-hole embodiment, various bonding techniques are particularly applicable to secure a conductive layer on the bottom surface of the insulting substrate 301. In addition, the anode 305 may be further shaped by a process involving a chemical-mechanical polishing.

After the anode 305 has been formed, a filling 307 is placed in the cavity 350. The filling 307 may be made from any material that sufficiently fills the cavity 350 to support the application of an etched conductive layer on top surface of the filling 307. In one embodiment, the filling 307 is configured to form a substantially flat, uniform surface at the opening of the cavity 350. In alternative embodiments, the top surface of the filling 307 may be configured to any other height relative to the bottom of the cavity 350. As described in more detail below, the height of the top surface of the filling 307 determines the height of the etched conductive layer (the grid) formed on the filling 307.

In one embodiment, the filling 307 may be a thick coat of polyimide disposed in the cavity 350. Although polyimide is used as the filling 307 in this illustrative embodiment, any filling material may be utilized in this step of the fabrication process. However, it is preferred to utilize a material that may be easily removed from the substrate 301 without damaging the oxidation layer 303 and anode 305.

Figure 2B:
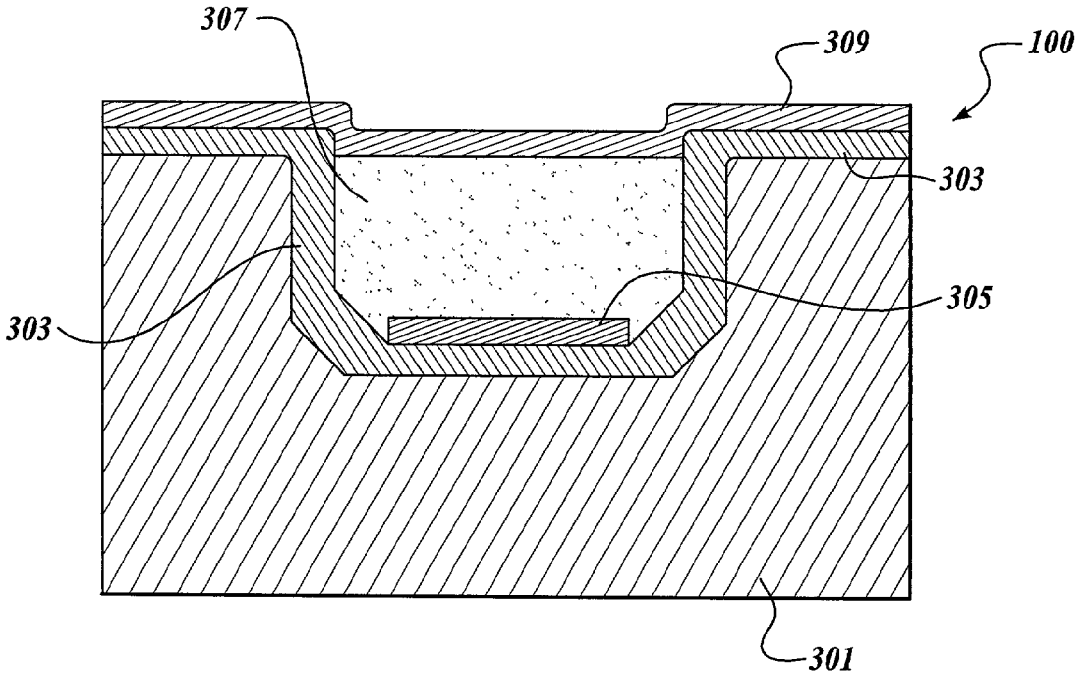

Referring now to FIG. 2B, the fabrication process continues with the application of a second conductive layer 309. In one embodiment, the second conductive layer 309 is applied on the top surface of the filling 307 at a thickness in the range of one micron to one millimeter. Although this illustrative embodiment utilizes a conductive layer thickness of one micron to one millimeter, any other thickness greater or less than this range may be applied in this step. The second conductive layer 309 may be made of any conductive material such as gold, tantalum, tungsten, nickel or the like. As shown in FIG. 2B, the second conductive layer 309 may be configured to cover the entire top surface of the device, thereby creating a conductive layer on the top surface of the filling 307 and a portion of the oxidation layer 303 covering the top surface of the substrate 301. The second conductive layer 309 may be disposed over the filling 307 and oxidation layer 303 by electroplating the selected conductive material directly on the filling 307 and the oxidation layer 303.

Figure 2C:
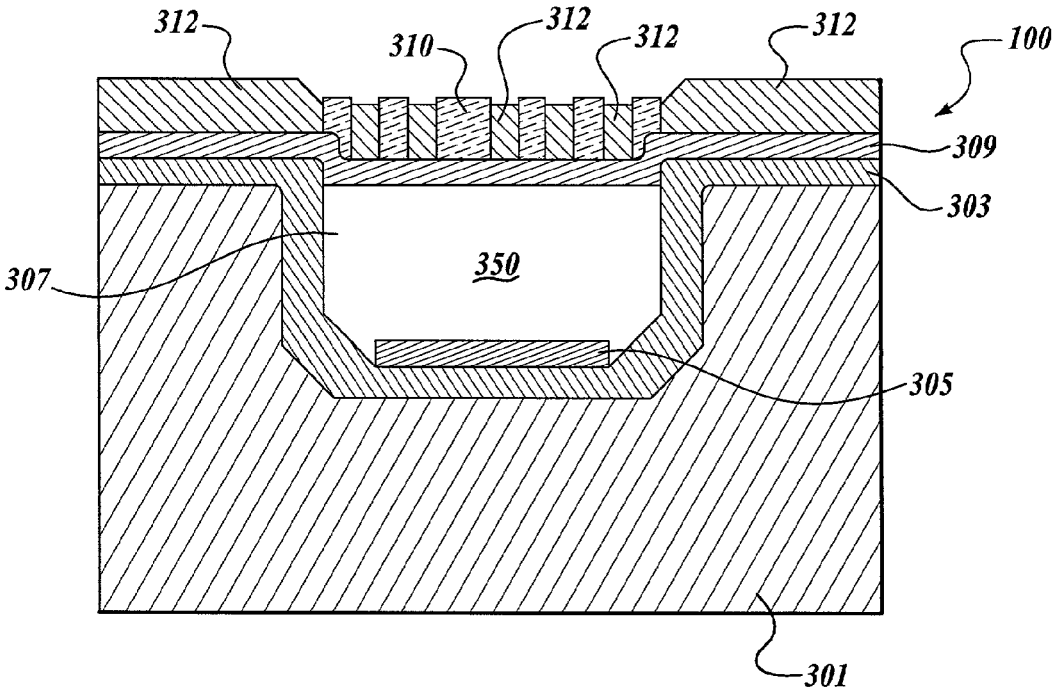

Referring now to FIG. 2C, the fabrication process then continues to a step where the grid 312 of the triode 100 is formed. As described in more detail below with reference to FIG. 3C, one embodiment of the triode 100 comprises a grid 312 that is configured from a thin conductive layer having a plurality of apertures therethrough. In another embodiment, the grid 312 may be configured in a plurality of straight bars as shown in FIG. 1.

Figure 2D:
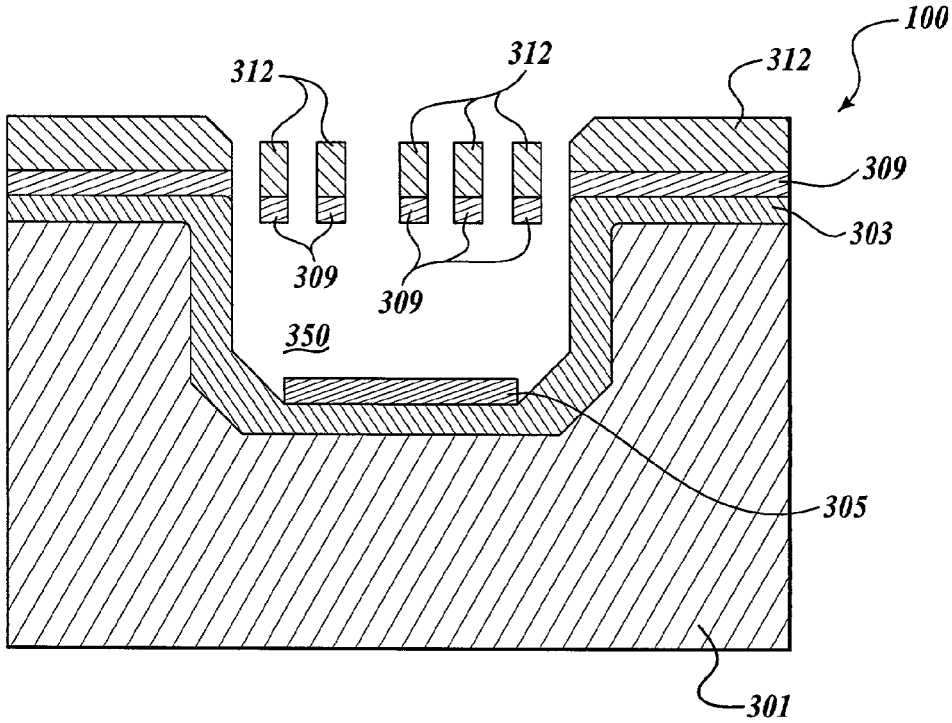

The grid 312 may be formed by the use of any known fabrication process for shaping formed metallic layers. In one embodiment, the grid 312 is formed by the use of a photo-resistive material 310 or other appropriate material that is shaped by a mask. As shown in FIG. 2C, the photo-resistive material 310 is applied to the top layer of the second conductive layer 309, and used to form the grid 312. In this illustrative example, upon the removal of the photo-resistive material 310, the grid 312 is formed in a location that is vertically positioned above the anode 305 as shown in FIG. 2D. Also shown in FIG. 2D, the etching process removes portions of the second conductive layer 309, thereby forming the second conductive layer 309 in the same shape and configuration as the grid 312.

Similar to the construction of the anode 305, the grid 312 may be constructed from any conductive material. For instance, in several examples, the grid 312 may be made of tungsten, gold, tantalum, nickel or any other like material. As described in more detail below with reference to FIG. 3C, the grid may comprise a plurality of apertures sized and configured to control the flow of electrons emitted from the cathode (351 of FIG. 1). In this embodiment, the grid 312 may have a thickness between 0.1 microns and one millimeter, and each aperture may be shaped into a square having 0.1 micron to more than one millimeter sides. In another embodiment, the grid can be configured to have the form of a conductor mesh with rectangular or other aperture shapes, suitable to microelectronic, micro electromechanical system (MEMS), micro-system-technology (MST), micromachining and other various metal fabrication and manufacturing techniques. In another embodiment, the grid 312 is formed into a plurality of bars having a height and width ranging from 0.1 microns to more than one millimeter. In one embodiment, the bars are substantially aligned on a plane that is substantially parallel to the surface of the anode or cathode. The distance between the bars of the grid 312 can be in the range of one micron to several centimeters. Although a range of one micron to several centimeters is utilized in these illustrative embodiments, the dimensions disclosed herein are provided for illustrative purposes only and not to be construed to limit the scope of the present invention.

Also shown in FIGS. 2C and 2D, the fabrication process also involves the removal of the filling 307. In this part of the fabrication process, the filling 307 may be removed by exposing the filling 307 to an appropriate wet or dry photo-etching process. In the removal of the filling 307, the filling 307 should be removed from the anode 305 to expose the top surface of the anode 305 to the grid 312.

Although the embodiment of FIGS. 2C and 2D has a grid 312 that is positioned near the opening of the cavity, the scope of the present invention also includes other embodiments where the grid 312 is positioned at a height above or below the opening of the cavity 350. For instance, in the above-described fabrication method, the filling 307 may be configured to only fill half of the cavity 350, thereby allowing the grid 312 to form at a level below the opening of the cavity 350. Alternatively, the filling 307 may be configured to form a substantially flat, uniform surface above the opening of the cavity 350, thereby allowing the formation of the grid 312 to be at a position above the opening of the cavity 350. There are many other techniques, methods, and ways including brazing, punching, spot welding, bonding, etc. to make the grid either singularly or in a combined fashion. For example, the grid can be secured directly on the top surface of the insulating substrate of ceramic, glasses, etc., similar to the anode, through various bonding and brazing techniques. In this example, the grid is separately fabricated using microelectronic, MEMS, MST, micromachining and other manufacturing techniques which may not require a filling process.

Figure 2E:
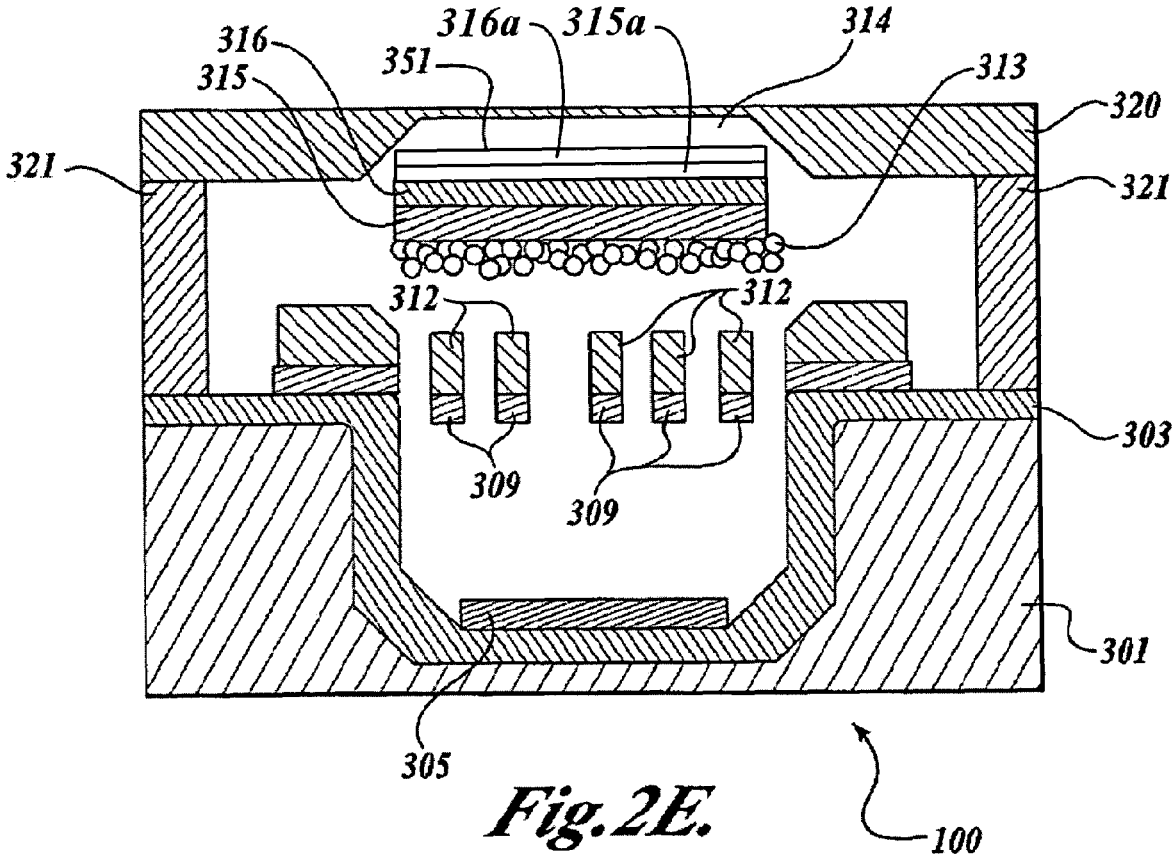

Referring now to FIG. 2E, the structure of one embodiment of the cathode 351 is shown. Generally described, the cathode 351 is formed into an air bridge structure that thermally isolates a heated electron emitting material 313 on the cathode 351 from other components of the triode 100. As shown in FIG. 2E, the air bridge structure is suspended over a cavity 314 of a base substrate 320. In one embodiment, the air bridge is affixed to the substrate 320 at opposite ends, leaving an open area between the cathode 351 and the substrate 320. In this illustrative embodiment, the air bridge structure of the cathode 351 is in the form of an elongated member comprising an insulating layer 316, conductive layer 315 and an electron-emitting material 313. In this embodiment, the conductive layer 315 functions as a thermal source to apply heat directly to the electron-emitting material 313.

Similar to the fabrication method described above with reference to FIGS. 2A and 2B, the air bridge structure of the cathode 351 may be formed by a fabrication process that employs a filling material. The fabrication process of the cathode 351 begins with a step where a cavity 314 is etched into a base substrate 320. The cavity 314 may be etched into the substrate 320 by a number of known fabrication processes, such as a wet etch, dry etch, or any other like method. In addition, the cavity 314 may be formed to any depth sufficient for creating an air gap between the cathode 351 and base substrate 320. Similar to the first substrate 301, the base substrate 320 of the cathode 351 may be made from any substrate material such as a single crystal, polycrystalline material, amorphous material, or any other semiconductor material. In yet another embodiment, the cavity 314 can be, similar to the case of the anode, a through-hole type of cavity, which can involve insulating substrates made of ceramic, glass, etc.

Once the cavity 314 is formed in the base substrate 320, a filling material (not shown) is then placed in the cavity 314. Similar to the filling 307 described above, the filling material formed in the cavity 314 provides a raised surface for the formation of the insulating and conductive layers 316 and 315. In a fabrication process similar to the fabrication method described above with reference to FIGS. 2A–2B, the insulating and conductive layers 316 and 315 are disposed on the filling material. Either a subtractive approach, as described above, or additive approaches can be used to create a cavity for the "air" bridge structure.

The insulating layer 316 can be made from any material having electrically resistive properties. For example, the insulating layer 316 may be made of ceramic, silicon dioxide or the like. In one embodiment, the insulating layer 316 is disposed on the filling material by the use of any generally known fabrication method such as wet oxidation, sputtering evaporation, or any other like method. The cathode 351 further comprises a conductive layer 315 disposed on the insulating layer 316. In this embodiment, the conductive layer 315 functions as a thermal source to heat the electron-emitting material 313. In one embodiment, the conductive layer 315 may be made of a low resistance metal that rises to high temperatures when a voltage source is applied thereto. Several examples of a conductive metal providing a thermal source include metals such as nickel, tantalum, platinum, tungsten molybdenum, chromium/tungsten, titanium tungsten, other conductive alloys, intermetallics, or the like. Although these metals are used in this illustrative example, any other conductive materials for creating a heat source may be used in the construction of any one of the embodiments disclosed herein. The conductive material 315 may be applied by a number of known fabrication methods, such as sputtering, evaporation, electroplating, CVD, etc. In the case of a through-hole type of cavity in the insulating substrate of ceramics, glasses, etc., various bonding techniques can be used to secure a conductor layer 315 on the surface of the substrate 320. In one embodiment, the insulating and conductive layer 316 and 315, respectively, each has a thickness in the range of less than 1 micron to greater than 1 millimeter. Although this range is used in this illustrative embodiment, the insulating and conductive layers 316 and 315 may be any other thickness greater or less than this range.

Figure 3B:
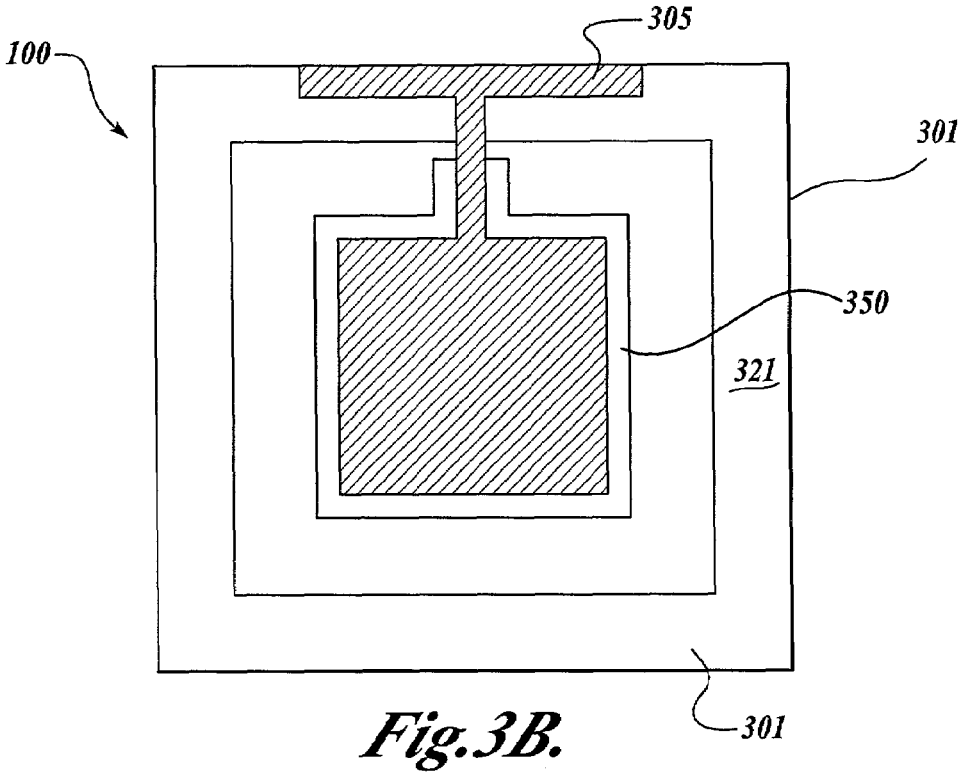
FIG. 3B is a top view of the substrate illustrated in FIG. 3A having an anode layer disposed thereon.
Figure 3C:
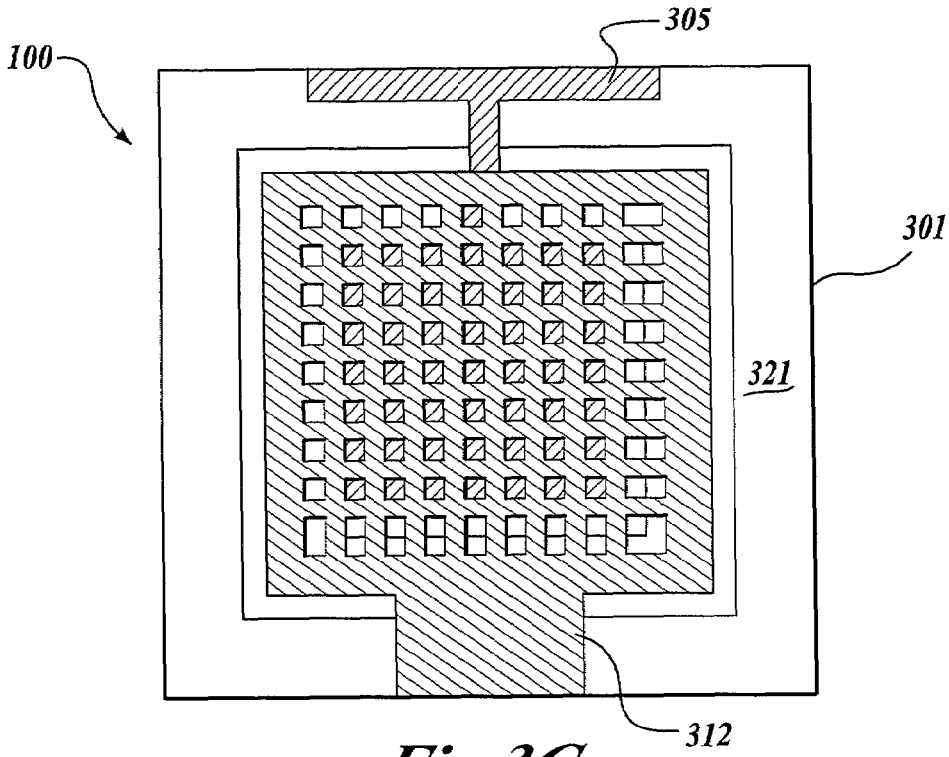
FIG. 3C is a top view of the substrate illustrated in FIG. 3B having a grid component disposed thereon.
Figure 3D:
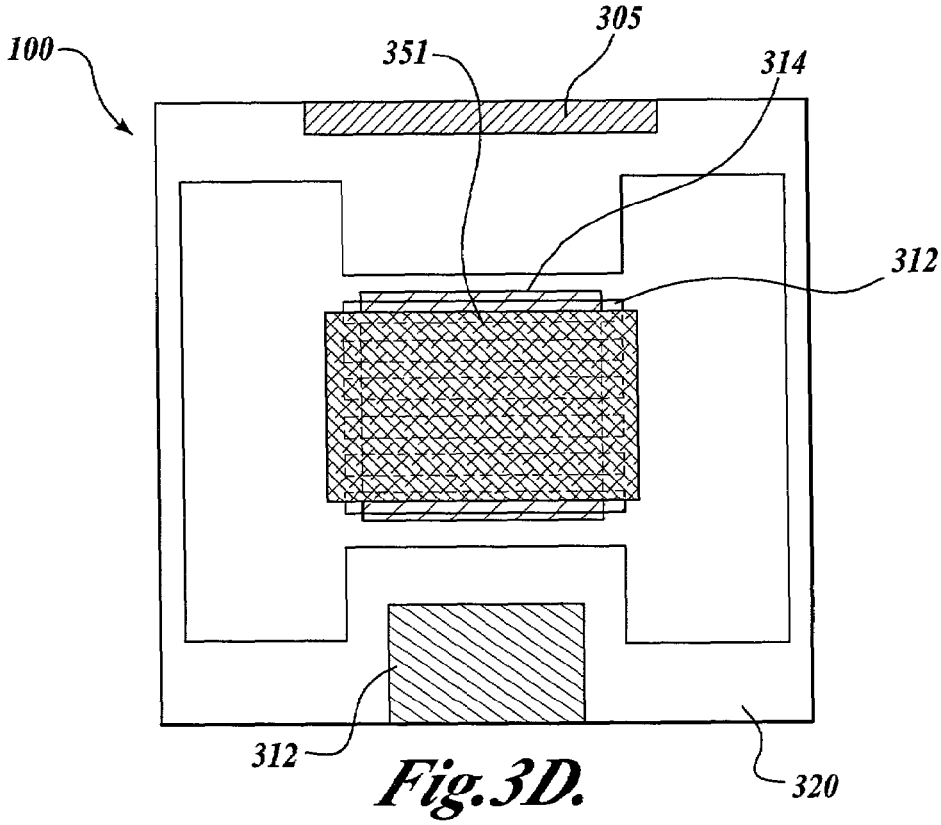
FIG. 3D is a top view of the substrate depicted in FIG. 3C having a cathode disposed thereon.

In one embodiment, the insulating and conductive layers 316 and 315 that form the cathode 351 are affixed to the substrate 320 at opposite ends of the air bridge. Referring to FIG. 3D, a top view of the cathode 351 illustrates the configuration of the cavity 314 in relation to the configuration of the conductive layers 316 and 315 that form the cathode 351. As shown, the insulating and conductive layers 316 and 315 are sized and shaped to span over the cavity 314, thus allowing the ends of the cathode 351 to attach to the substrate 320 near the opening of the cavity 314. In another embodiments, the air bridge structure of the cathode 351 may be attached to one, three or all sides of the cathode 351. Once the cathode 351 is formed, the filling material in the cavity 314 may be removed by exposing the filling material to an appropriate wet or dry photo-etching process.

Once the conductive layers 316 and 315 are formed, the electron emitting material 313 is disposed on the conductive layer 315. In one embodiment, the electron emitting material 313 may be a monocarbonate to a tricarbonate, or a suitable metal or mix of metals such as an alkaline with metal or mixtures thereof. In one embodiment the tricarbonate is deposited onto the cathode 351 by a conventional procedure, such as electrophoresis. Alternatively, the electron emitting material 313 may be sprayed onto the cathode 351 surface. By these processes, carbonates of several elements such as strontium, calcium and barium can be deposited onto the conductive layer 315. Although these examples are disclosed for illustrating one embodiment, any other low work function material may be used in the application of the electron emitting material 313.

The above-described process is illustrative of one embodiment of a cathode that is directly heated. For indirectly heated cathodes, there are numerous embodiments that can be employed. For example, an additional insulating layer 316*a* and an additional conducting layer 315*a* can be established on the conductive layer 315, or conductive layers 316 and 315, together as the indirectly heated cathode. In such an embodiment, the conductive layer 315 or the both conductive layers 316 and 315 together function as the heater for the cathode. Electron emission materials, in this case, will be deposited on top of the cathode conductor. As of the conductor being bonded on the surface of the insulating substrate of ceramics, glasses, etc., this suspended conducting layer can be used as either the heater conductor or the cathode conductor depending on the manufacturing processes and applications of the devices. Subsequent buildup of either the heater or the cathode will follow accordingly.

In one embodiment of the above-described fabrication method, it may be preferred to remove the filling material under the air bridge structure after the electron emitting material 313 is disposed on the conductive layer 315. This embodiment allows the filling material to support the air bridge structure of the cathode 351 during the application of the electron emitting material 313.

Although a cathode 351 having a conductive 315 layer and insulating layer 316 is disclosed as one illustrative embodiment, the cathode 351 may comprise a variety of layers or combinations of layers to form the air bridge of the cathode 351. For instance, in another embodiment, the cathode 351 shown in FIG. 2E may comprise an additional second insulating layer and a second conductive layer disposed between the electron emitting material 313 and conductive layer 315. In this embodiment, the second insulating layer is directly deposited onto the conductive layer 315 of the cathode 351. The second insulating layer may be configured to any thickness and can be made from any material having electrically resistive properties. Next, the second conductive layer is disposed on the second insulating layer. The second conductive layer may be configured to any thickness and is made from any electrically conductive material such as tungsten, nickel, gold, tantalum, or any other like material. By the use of the fabrication process described above, the electron emitting material 313 is then disposed on the second conductive layer.

In yet another embodiment, the cathode 351 comprises a single conductive layer and an electron emitting material. In this embodiment, the single conductive layer is configured in a manner similar to the configuration of the insulating layer 316 of FIG. 2E. More specifically, the single conductive layer of this embodiment is disposed on a filling material in the cavity and shaped to form an air bridge structure over the cavity when the filling material is removed. The single conductive layer may be configured to any thickness and is made from a low resistance metal that rises to high temperatures when a voltage source is applied thereto. The electron emitting material is then disposed directly onto the single conductive layer. In this embodiment, other optional layers may be positioned between the single conductive layer and the electron emitting material. For instance, an insulating layer may be positioned on the single conductive layer and a second conductive layer may be placed between the insulating layer and the electron emitting material.

Referring again to FIG. 2E, the cathode 351 is affixed in a position such that the electron emitting material 313 is vertically aligned above the cavity and oriented to face the grid 312 and anode 305. Also shown in FIG. 2E, the cathode 351 is affixed to the first substrate 301 by a seal 321. The seal 321 may be constructed of any material that is capable of holding the cathode 351 structure to the first substrate 301. The seal 321 may be made of any material, such as silicon dioxide, of sufficient strength to hold the cathode 351 in place. In addition, the seal 321 should be made of a material having a sufficient strength for maintaining a controlled environment, such as a vacuum environment, around the cathode 351, anode 305 and grid 312. The seal 321 may be in any form, such as an elongated section of silicon dioxide (FIG. 2E) or a raised section of the first substrate 301.

When the second substrate 320 of the cathode 351 is affixed to the first substrate 301, all oxygen and other impure gasses are removed from the area surrounding the cathode 351, grid 312, and anode 305. In one embodiment, a vacuum environment is formed in the enclosed area created by the seal 321, first substrate 301 and second substrate 320. The pressure of a vacuum is often controlled envision meant having an extremely reduced oxygen content prevents oxidation as often degradation of the component and materials existing within the region of the controlled environment. Alternatively, the enclosed area created by the seal 321, first substrate 301 and second substrate 320 may be filled with a gas that permits the flow of electrons between the cathode 351 and anode 305. Such examples of a filling gas include hydrogen, helium, argon, and mercury. In the construction of the through-hole embodiment, the outer surface of the through-hole in the substrate 320 can be sealed by the use of another platform, such as a carrier of the circuit. This carrier can be microelectronic MEMS, MST, or other types of packaging materials such as semiconductors, ceramics, glasses, etc. Referring now to FIGS. 3A–3D, a top view of various components of the triode 100 is shown. In summary, FIGS. 3A and 3B illustrate the top view of one embodiment of the anode 305 and cavity 350 formed in the substrate 301, and FIGS. 3C and 3D illustrate a top view of one embodiment of the cathode 351 and grid 107 positioned over the cavity 351.

FIG. 3A illustrates one embodiment of a cavity 350 formed in the substrate 301. In this illustrative embodiment, the cavity 350 is formed into a substantially square shape. The cavity 350 also comprises an external groove to allow components to extend from the bottom of the cavity 350 to a portion of the substrate 301 that is external to the cavity 350. As shown in FIG. 3B, the anode 305 is disposed in the cavity 350. Any one of the above-described fabrication methods may be utilized to form the anode 305. Also shown in FIG. 3B, a portion of the anode 305 is formed in the groove to extend from the cavity 350 to a portion of the substrate 301 that is external to the cavity 350. The portion of the anode 305 that is external to the cavity 350 provides a communication path that allows external electronics, such as an anode voltage controller (704 of FIG. 7), to communicate with the anode 305.

Referring now to FIG. 3C, a top view of one embodiment of the grid 312 is shown. As shown in FIG. 3C, this embodiment of the grid 312 forms a substantially flat conductive layer that is vertically positioned over the cavity 351 and grid 305. The plane defined by the surface of the grid 312 is substantially parallel to the plane defined by the surface of the anode 305. Also shown in FIG. 3C, this embodiment of the grid 312 has a number of apertures through grid 312. In one embodiment, the dimension of each aperture may be approximately 500 square microns. Although a configuration of a grid having square apertures is utilized in this illustrative example, any a grid 312 having at least one aperture for allowing the passage of electrons can be utilized in forming any one of the embodiments disclosed herein. For instance, the grid can also be formed into elongated electrical conductors, conductors which form a grid pattern of a plurality of "wires" that are formed to influence the passage of electrons. In addition, the grid 312 may be in any position relative to the anode 305 and cavity 350 so long as the grid 312 allows the selective passage of electrons from the cathode 351 to the anode 305. The grid 312 is also formed with an external contact for allowing an electrical connection between the grid 312 and other external circuits.

Referring now to FIG. 3D, a top view of the triode 100 illustrates the one embodiment of the cathode 351 of the triode 100. In one embodiment, the cathode 351 is positioned vertically above over the grid 312 and configured with external contacts, or an equivalent thereof, for allowing external electronics to be electronically connected to cathode 351. Although this embodiment of the cathode 351 is formed in a square configuration, the cathode 351 can be in any form that allows the cathode 351 to emit charged carriers, such as electrons. In addition, FIG. 3D illustrates the orientation of the cavity 314 in the cathode substrate 320 relative to the orientation and configuration of the cathode 351. As described above, the cathode 351 is sized such that the ends of the cathode 351 extend over walls of the cavity 314 formed in the cathode substrate 320. Thus, in this configuration, the ends of the cathode 351 can be affixed to the cathode substrate 320 near the opening of the cavity 314. The cathode could be either a solid area covering part, all, or more than the heater conductive layers or a patterned layer having any appropriate shape.

Now that the fabrication process of one solid state vacuum device has been described in detail, several alternative embodiments will now be shown and described. More specifically, FIGS. 4–7 illustrate other triode embodiments and other devices such as a diode and pentode configuration. As can be appreciated by one of ordinary skill in the art, in view of the above-described fabrication process, other embodiments such as a diode and other higher order devices described below can be formed.

Figure 4:
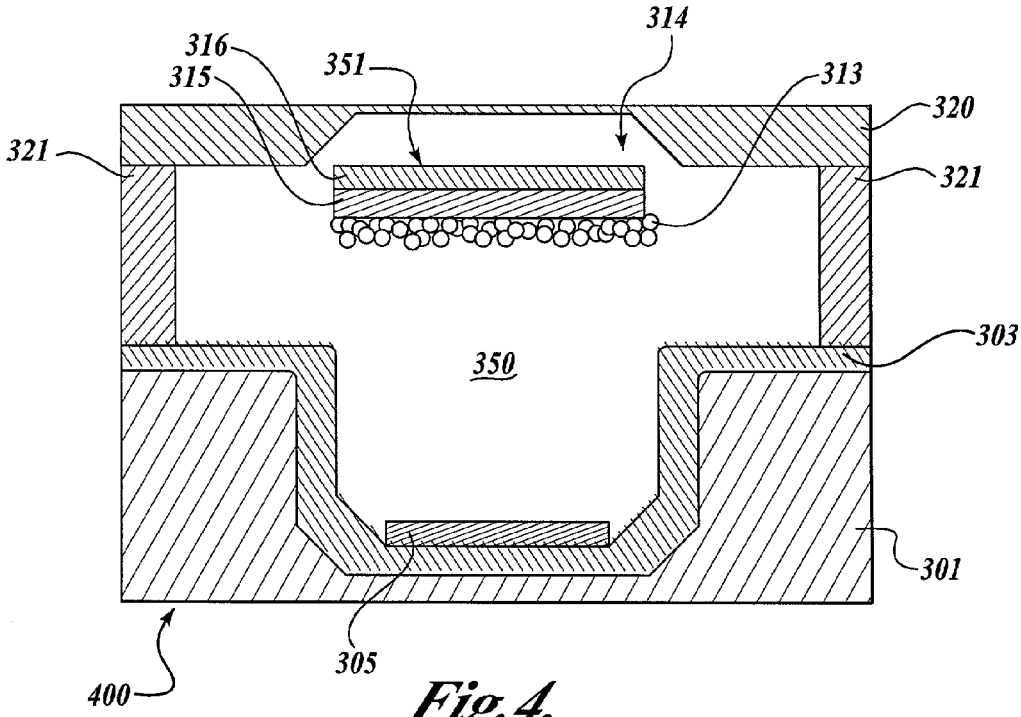
FIG. 4 is a side front cross-sectional view of one embodiment of a solid state vacuum device of the present invention in a diode configuration.

Referring now to FIG. 4, one embodiment of a solid state vacuum device forming a diode 400 is shown and described below. Generally described, the diode 400 comprises a substrate 301 having a cavity 350 etched into the substrate 301. In addition, the diode 400 also comprises an anode 305 and a cathode 351. In one embodiment, the cathode 351 comprises a conductive layer 316, insulating layer 315, and an electron-emitting material 313. The diode 400 further comprises a seal 321 for creating a vacuum environment in the area surrounding the anode 305 and cathode 351.

As shown in FIG. 4, the various components of the diode 400 are constructed in a manner similar to the construction of the components described above with reference to the triode 100 depicted in FIGS. 1–3D. For instance, the diode 400 may comprise an oxide layer 303 having a thickness of 2 microns and a formed anode 305 applied thereon. In addition, the cavity 350, anode 305, cathode 351 and seal 321 of this embodiment may be constructed by the use of a fabrication process similar to the fabrication process described above with reference to FIGS. 2A–2E.

The operation of the diode is similar to that of a standard diode; however, in this embodiment, the diode 400 is operated by the activation of the thermal source 314. In response to the activating the thermal source 314, electrons are emitted from the cathode 351 and received by the anode 305. Similar to the triode 100 of FIG. 1, the anode 305 of the diode configuration produces a current source for an external circuit.

Figure 5:
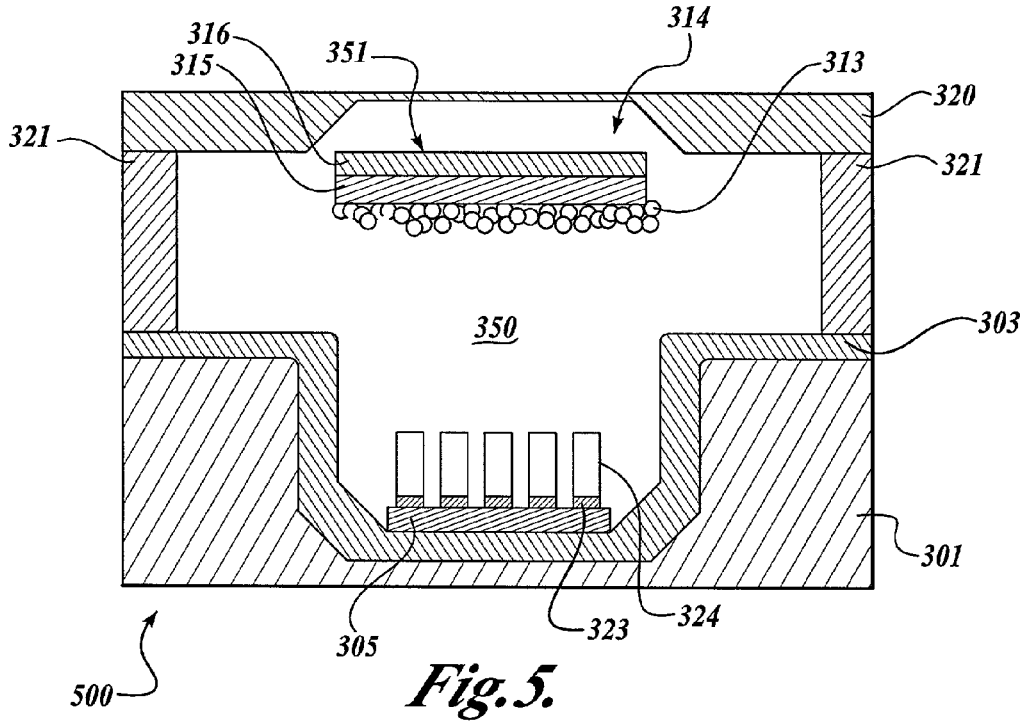
FIG. 5 is a side front cross-sectional view of one embodiment of a solid state vacuum device of the present invention in a tetrode configuration having a grid component disposed on an anode component.

Referring now to FIG. 5, one embodiment of a solid state vacuum device forming another embodiment of a triode 500 is shown and described below. This embodiment of the triode 500 comprises a substrate 301 having a cavity 350 etched into the substrate 301. The triode 500 further comprises an anode 305 and cathode 351. As shown, the anode 305 and cathode 351 are constructed in a manner similar to the anode 305 and cathode 351 of the embodiment illustrated in FIG. 1. In addition, the triode 500 depicted in FIG. 5 comprises a grid 324 that is disposed directly onto the anode 305. Also shown in FIG. 5, this embodiment of the triode 500 further comprises an insulating layer 323 for providing electronic insulation between the anode 305 and grid 324.

As shown in FIG. 5, the various components of the triode 500 are constructed in a manner similar to the construction of the components described above with reference to the triode 100 depicted in FIGS. 1–3D. More specifically, the cavity 350, anode 305, cathode 351 and seal 321 of this embodiment may be constructed by the use of a fabrication process similar to the fabrication process described above with reference to FIGS. 2A–2E. The insulating layer 323 and grid 324 of the embodiment are constructed in a manner similar to the construction of the orientation layer 303 and grid 312 of the embodiment illustrated in FIGS. 1–3D. More specifically, the insulating layer 323 may be made of any resistive material such as ceramic, silicone dioxide, silicon nitride, or any other like material. Any fabrication process used for depositing such a resistive material may be utilized to configure the insulating layer 323. The grid 324 is deposited onto the insulating layer 323 by the use of any fabrication process capable of disposing a formed conductive layer. In one embodiment, the grid 324 may be formed by the use of an etching process utilizing a photo-resistive material. In one embodiment, the grid 324 may take the form of the grid (312 of FIG. 3C) having a plurality of square apertures. The grid 324 of this embodiment may be made of any conductive material and formed in any shape having at least one aperture for allowing the passage of electrons. The heights of each layer can be in the range of much less than 1 micron to greater than one millimeter.

Figure 6:
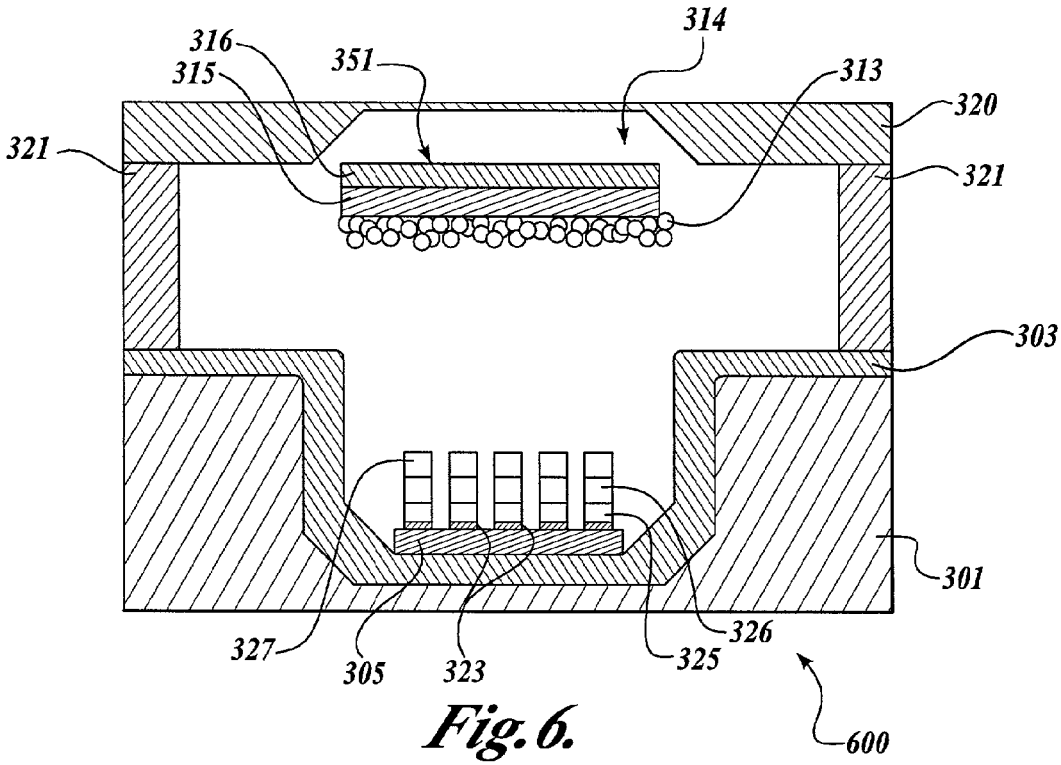
FIG. 6 is a side front cross-sectional view of one embodiment of a solid state vacuum device of the present invention in a tetrode configuration having two grid layers disposed on an anode component.

Referring now to FIG. 6, another embodiment of a solid state vacuum device forming a tetrode 600 is shown and described below. Generally described, the tetrode 600 comprises the general components of the triode 500 illustrated in FIG. 5. For instance, the triode 500 comprises an anode 305 and cathode 351 having the same configuration as the anode 305 and cathode 351 described above with reference to FIG. 2E. The tetrode 600 further comprises two grid (electrode) layers 325 and 327 positioned between the anode 305 and cathode 351, and two insulating layers 323 and 326 respectively disposed next to each grid layer 325 and 327.

The two grid layers 325 and 327 of the tetrode 600 of FIG. 6 have a configuration similar to the grid layer 324 of the triode 500 shown in FIG. 5. In one embodiment, each grid layer 325 and 327 may have a thickness in the range of one micron to one millimeter. In other illustrative embodiments, each grid 325 and 327 may have a thickness greater than one millimeter or less than one micron. In addition, each grid 325 and 327 may be configured in the form of a conductive layer having a plurality of apertures, as shown in the embodiment of FIG. 3C. Alternatively, each grid 325 and 327 may be configured in the form of a plurality of bars extending over the anode 305. Similar to the triode 500 of FIG. 5, the each grid layer 325 and 327 may be made from any conductive material and the insulating layers 323 and 326 may be made from any electrically resistive material.

The construction of the tetrode 600 involves a fabrication process similar to the above-described fabrication process (FIGS. 2A–2E) for constructing the triode 100 of FIG. 1. For instance, the substrate 301 may be formed from the same fabrication process as described above with respect to the substrate 301 shown in FIGS. 2A–2E. The anode 305 and cathode 351 are also made by the process described above with respect to FIGS. 2A–2E.

In the tetrode 600 shown in FIG. 6, the configuration of the first grid layer 325 and the first insulating layer 323 is similar to the configuration of the grid layer 323 and the insulating layer 324 shown and described above with reference to FIG. 5. For example, as described above, the first grid layer 325 and the first insulating layer 323 may be configured by the use of a patterned mask layer and an effective etchant. The fabrication process for the tetrode 600 also involves a second etching process to form the second insulating layer 325 and second grid layer 327 on top of the first grid layer 326. The fabrication process (FIGS. 2A–2E) utilizing the photo-resistive material may also be utilized to form second grid layer 327.

Figure 7:
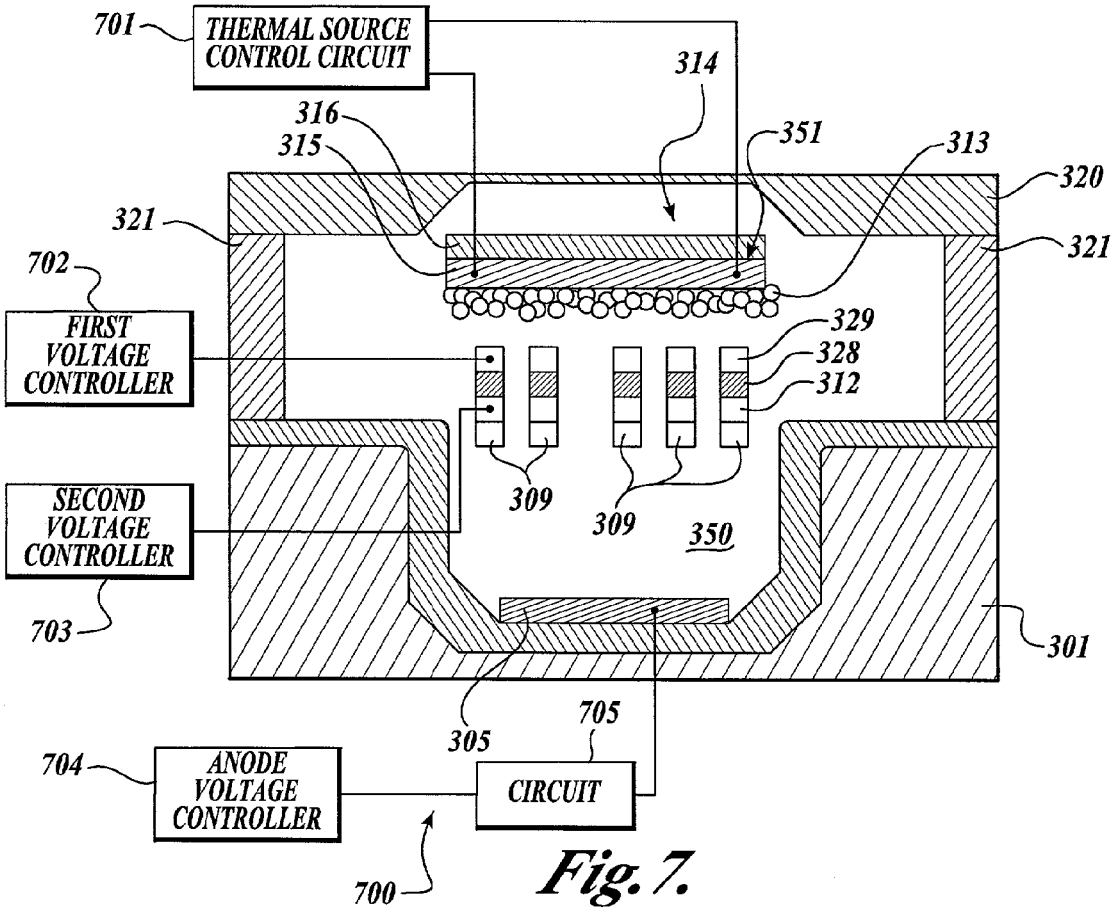
FIG. 7 is a side front cross-sectional view of one embodiment of a solid state vacuum device in a tetrode configuration having two grid layers suspended between a cathode and anode.

Referring now to FIG. 7, yet another embodiment of a solid state vacuum device forming a tetrode 700 is shown and described below. Generally described, the tetrode 700 comprises an anode 305, cathode 351, and a plurality of grid layers 312 and 329. The anode 305 and cathode 351 of this embodiment are constructed in a manner similar to the anode 305 and cathode 351 depicted in FIG. 2E and described above. The first grid 312 and seal 321 are also constructed in a manner similar to the grid 312 and seal 321 of the triode 100 depicted in FIG. 2E. The first grid 312 comprises at least one aperture for allowing the passage of electrons through the grid 312. The second grid 329 is positioned above the first grid 312, and the second grid 329 is separated from the first grid 312 by an insulating layer 328. The second conductive layer 309 can be another conductor, a low secondary-electron-emission conductor, or an insulator layer depending on applications and purpose.

In one embodiment, the first and second grid 312 and 329 are configured in the form of a conductive layer having a plurality of apertures, as shown in the embodiment of FIG. 3C. Alternatively, the first and second grid 312 and 329 may be configured in the form of a plurality of bars extending over the anode 305. As described above, the first and second grid 312 and 329 may be made of any conductive material and formed in any shape having at least one aperture for allowing the passage of electrons.

The fabrication process for constructing the tetrode 700 of FIG. 7 is similar to the fabrication process described above with reference to FIGS. 2A–2E. In addition, the fabrication process for constructing the tetrode 700 further comprises the fabrication of a second grid layer 329. More specifically, the second grid layer 329 and insulating layer 328 are disposed onto an insulating layer 328, by the use of any fabrication process for shaping formed layers. As applied to any of the tetrode configurations described herein, the two grids layers may be positioned such that the apertures of each grid layer align with one another. Adding another grid between the control grid and the anode helps to screen or isolate the control grid from the anode. This reduces the so-called Miller effect, which has certain effects on the capacitance between the grid and anode. The addition of another screen also causes an electron-accelerating effect, which increases the gain of the device. Also illustrated in FIG. 7, the various circuit components utilized in the operation of a solid state vacuum device, such as a tetrode 700, are shown. As shown in FIG. 7, a thermal source control circuit 701 is electronically connected to the conductive layer 315, also referred to as the thermal source of the cathode 314. The thermal source control circuit 701 supplies a voltage to the conductive layer 315 causing the conductive layer 315 and the electron-emitting material 313 to heat. Once brought to a sufficient temperature, the electron-emitting material 313 emits electrons, which are ultimately received by the anode 305.

In this illustrative example, an anode voltage controller 704 is electronically connected to the anode 305 for providing a positive voltage to the anode 305 so that it attracts electrons emitted from the electron-emitting material 313. As described above, in response to receiving electrons, the anode 305 produces an electrical current that can be utilized by external circuitry 705. A first voltage controller 702 is connected to one grid layer 329 and a second voltage controller 703 is electronically connected to the other grid layer 328. Similar to a control circuit of a traditional tetrode formed in a vacuum tube, the first and second voltage controllers 702 and 703 provide a varied voltage signal to the grid layers 328 and 329 to control the flow of electrons received by the anode 305. In other embodiments, any of the voltage controllers, such as the second voltage controller 703, may be coupled to a ground source. Accordingly, the amount of electrons received by the anode effectively controls the current produced by the anode 305. The current produced by the anode 305 is then communicated to an external circuit 705. Although this embodiment illustrates a tetrode having two independent voltage controllers for each grid, other embodiments having one or more control circuits can be used to control any number of grid layers of the solid state vacuum devices disclosed herein.

By the use of the fabrication methods disclosed herein, other higher order devices can be implemented by applying additional grid layers on top of the grid layers of any one of the embodiments described herein. The additional grid layers may be applied to any one of the disclosed embodiments by the use of any one of the above-described fabrication methods. For instance, in an example utilizing the embodiments of FIGS. 6 and 7, a solid state vacuum device may further comprise third and fourth grid layers positioned above the second grid layer (327 of FIG. 6 and 329 of FIG. 7) of a tetrode. In this example, an insulating layer, such as silicon dioxide, may be disposed on the second grid layer to provide a supporting surface for the third and fourth grid layers. Similar to the first and second grid layers, an insulating layer is sandwiched between the third and fourth grid layers to inhibit electrical communication between the grid layers. Such an embodiment is shown in the embodiment illustrated in FIG. 8.

Figure 8:
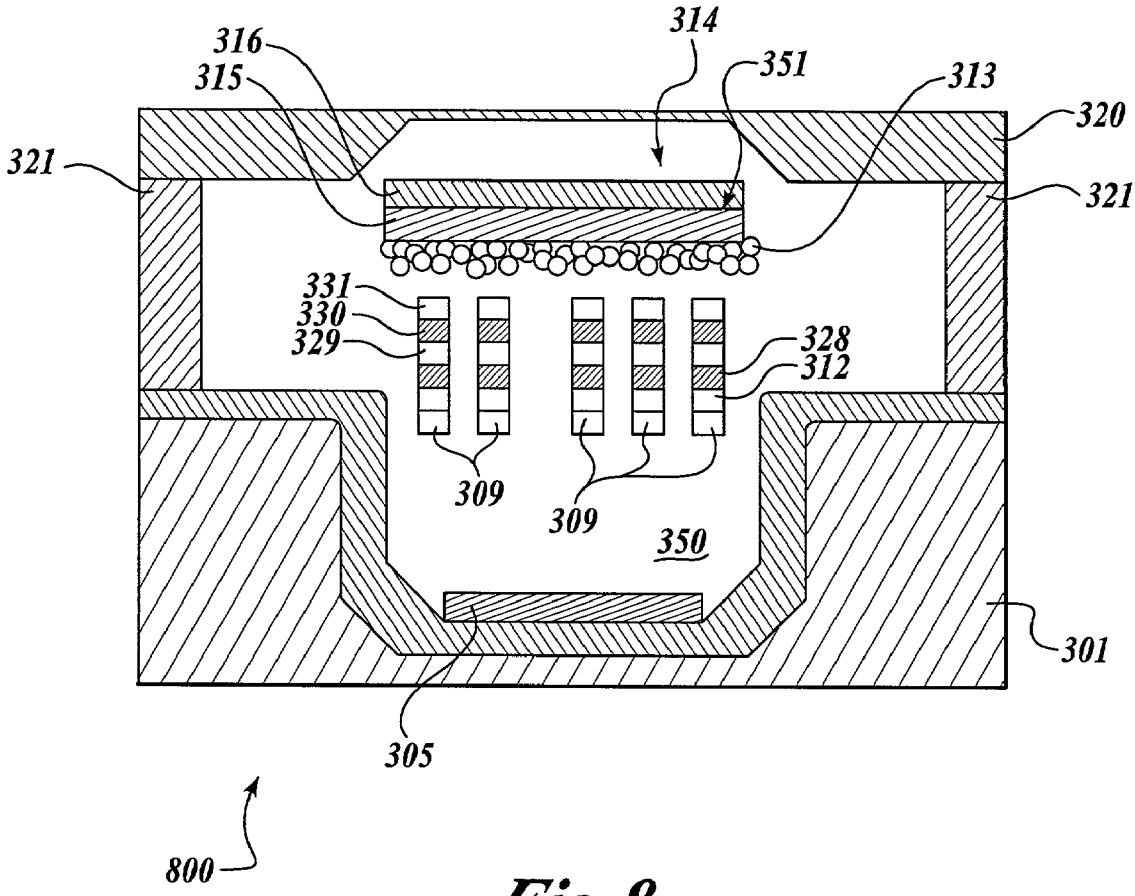
FIG. 8 is a side front cross-sectional view of one embodiment of a solid state vacuum device in a pentode configuration having three grid layers suspended between a cathode and anode.

The pentode device 800 of FIG. 8 is similar in construction to the device shown in FIG. 7. However, the pentode device 800 of FIG. 8 includes a more sophisticated grid construction. The cathode construction and location are similar as is the anode position and construction. The device of FIG. 7 presents two voltage controllers to control. Voltages within the grid while the grid construction of FIG. 8 permits these control voltages to be surpassed on the grid. (Voltage control circuits are not shown). The composition of electrode 331, 329, and 312 of the pentode 800 are similar to the respective components of the tetrode 700, while the components referenced as 330 and 328 are similar in composition, construction and purpose. Components 329, 328, 312 as well as 319 are all described with reference to FIG. 7. The pentode device 800 is adapted to permit more control of electrons flowing from the cathode to the anode.

Employing such multi-grid devices, as described above, will result in improvements in the gain and frequency performance of the device. In conventional vacuum device manufacturing, it is difficult to achieve desired grid alignment both due to the physical configuration of the grid. For example, in the form of a helix and the manufacturing method used for form the helix, such as a wire winding. Accordingly, the methods, techniques and approaches of the present invention provide a better alignment of the multi-grids. In addition, the methods, techniques and approaches of the present invention provide an improved manufacturing process of such multi-grids.

While several embodiments of the invention have been illustrated and described, it will be appreciated that various changes can be made therein without departing from the spirit and scope of the invention. Similarly, any process steps described herein might be interchangeable with other steps in order to achieve the same result. In addition, the illustrative examples described above are not intended to be exhaustive or to limit the invention to the precise forms disclosed. For instance, one embodiment of a solid state vacuum device may comprise an array having a number of diodes, triodes, or any other higher-order devices combined onto one substrate. By fabricating duplicate devices, or various combinations thereof, on one substrate, high-power solid state vacuum device can be formed. In such a modification, each individual device should be separated and insulated from one another by the use of gaps or voids. In addition, such device arrays should be separated by a high temperature insulator material such as ceramic, silicon dioxide, sapphire, or the like.

The embodiments of the invention in which an exclusive property or privilege is claimed are defined as follows:

1. A device, comprising:

a substrate having a cavity that extends into the substrate, the cavity having an opening on at least one surface of the substrate;

an anode positioned within the cavity of the substrate;

a cathode comprising a first insulating layer positioned above the opening of the cavity, wherein the anode receives electrons emitted by the cathode, and wherein the anode produces an electrical current to an external source in response to receiving the electrons;

a first grid having at least one aperture to allow the passage of electrons therethrough, wherein the first grid is constructed of an electrically conductive material, and wherein the aperture of the first grid is positioned between the cathode and anode;

a second grid having a plurality of apertures configured for allowing the passage of electrons therethrough, wherein the aperture of the second grid is positioned between the cathode and anode, and wherein the second grid controls the flow of electrons from the cathode to the anode when a control voltage is applied to the second grid;

a seal for creating a controlled environment in an area surrounding the first grid, the cathode and the anode, wherein the controlled environment allows for electron flow between the cathode, first grid and anode;

a circuit for heating the cathode, and a control circuit for controlling the magnitude of the flow of electrons through the aperture of the first grid, thereby controlling the electrical current produced by the anode.

2. The device of claim 1, wherein the plurality of apertures of the second grid are aligned with the plurality of apertures of the first grid.

3. The device of claim 1, wherein the cathode is attached to the substrate to create a vacuum environment in an area surrounding the first grid, second grid, anode and cathode.

4. The device of claim 1, wherein the cathode comprises an electron emitting coating disposed thereon, the electron emitting coating comprises at least one of a metal tricarbonate, strontium, calcium or barium.

* * * * *